US011285721B2

(12) United States Patent
Xie et al.

(10) Patent No.: US 11,285,721 B2
(45) Date of Patent: Mar. 29, 2022

(54) PIEZOELECTRIC PRINTING DEVICE WITH SINGLE LAYER INNER ELECTRODE

(71) Applicant: Suzhou New RealFast Technology CO., LTD, Suzhou (CN)

(72) Inventors: Yonglin Xie, Suzhou (CN); Xiaofei Zhang, Suzhou (CN)

(73) Assignee: Suzhou Ruifa Printing Technology & Co, Ltd, Suzhou (CN)

( * ) Notice: Subject to any disclaimer, the term of this patent is extended or adjusted under 35 U.S.C. 154(b) by 0 days.

(21) Appl. No.: 16/912,844

(22) Filed: Jun. 26, 2020

(65) Prior Publication Data

US 2021/0354469 A1 Nov. 18, 2021

(30) Foreign Application Priority Data

May 13, 2020 (CN) ..... 202010400961.7

(51) Int. Cl.
*B41J 2/14* (2006.01)
*B41J 2/045* (2006.01)
*B41J 2/16* (2006.01)

(52) U.S. Cl.
CPC ..... *B41J 2/14201* (2013.01); *B41J 2/045* (2013.01); *B41J 2/1623* (2013.01); *B41J 2002/14491* (2013.01)

(58) Field of Classification Search
CPC ..... B41J 2/14201; B41J 2/1623; B41J 2/045; B41J 2002/14491
See application file for complete search history.

(56) References Cited

U.S. PATENT DOCUMENTS 5,255,016 A 10/1993 Usui et al.
5,640,184 A 6/1997 Moynihan et al.
6,243,114 B1 6/2001 Yano et al.
2004/0004649 A1* 1/2004 Bibi ..... B41J 2/1642 347/68

FOREIGN PATENT DOCUMENTS

CN 107344453 A 11/2017

OTHER PUBLICATIONS ip.com search (Year: 2021).*

* cited by examiner

*Primary Examiner* — Lisa Solomon
(74) *Attorney, Agent, or Firm* — Gary A. Kneezel

(57) ABSTRACT

A piezoelectric printing device includes a substrate and a piezoelectric plate. At least one row of drop ejectors is disposed along a row direction. Each drop ejector includes a nozzle in fluid communication with a pressure chamber that is bounded by side walls. The piezoelectric plate has a first surface that is disposed proximate to the first side of the substrate. A bonding layer is disposed between the piezoelectric plate and the substrate. An electrode layer is disposed between the first surface of the piezoelectric plate and the bonding layer. The electrode layer includes a signal line corresponding to each pressure chamber. Each signal line leads to a signal input pad. The electrode layer also includes ground traces disposed on both sides of each pressure chamber. The ground traces are electrically connected to at least one common ground bus that is electrically connected to at least one ground return pad.

25 Claims, 13 Drawing Sheets

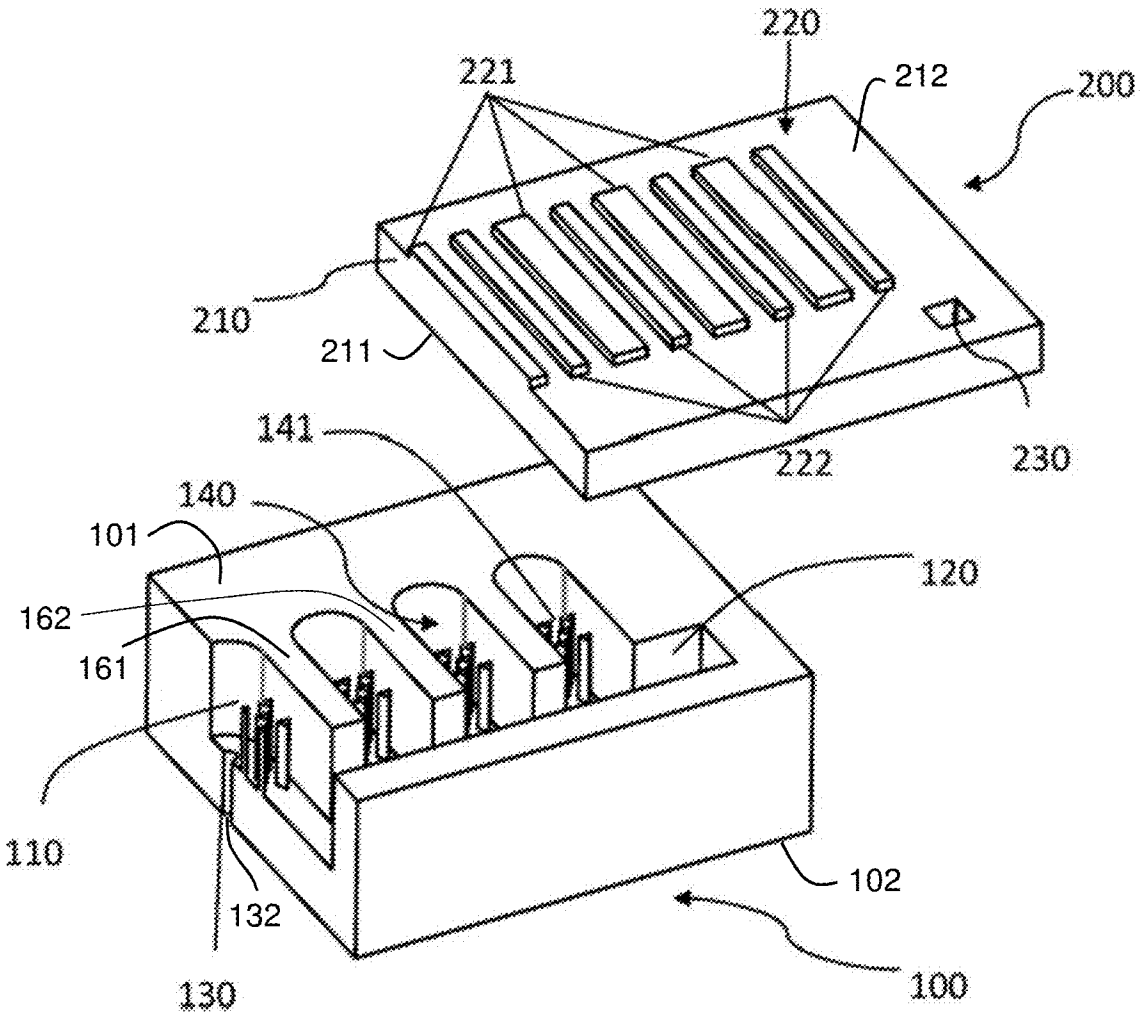
FIG. 1 – PRIOR ART

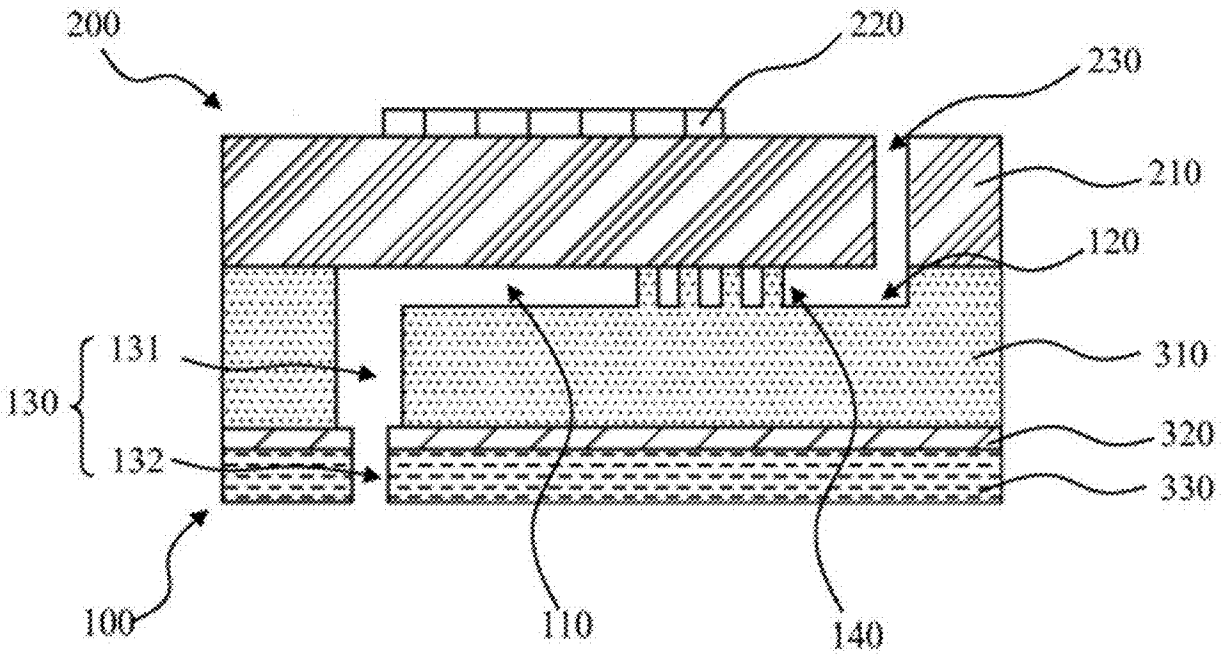
FIG. 2 – PRIOR ART

PIEZOELECTRIC PRINTING DEVICE WITH SINGLE LAYER INNER ELECTRODE

CROSS REFERENCE TO RELATED APPLICATIONS

Reference is made to commonly assigned, patent application Ser. No. 16/912,769, entitled: "Piezoelectric printing device with outer layer surface electrode"; patent application Ser. No. 16/912,783, entitled: "Piezoelectric printing device with inner layer surface electrode"; patent application Ser. No. 16/912,816, entitled: "Piezoelectric printing device with vias through piezoelectric plate"; patent application Ser. No. 16/912,791, entitled: "Piezoelectric printhead and printing system"; and patent application Ser. No. 16/912,833, entitled: "Piezoelectric printhead for multiple inks and printing system"; filed concurrently herewith, and incorporated herein by reference.

FIELD OF THE INVENTION

This invention pertains to the field of piezoelectric inkjet printing and more particularly to configurations of a piezoelectric printing device.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image. The desired image can include any pattern of dots directed by image data. It can include graphic or text images. It can also include patterns of dots for printing functional devices or three dimensional structures if appropriate inks are used. Ink can include colored ink such as cyan, magenta, yellow or black. Alternatively ink can include conductive material, dielectric material, magnetic material, or semiconductor material for functional printing. Ink can include biological, chemical or medical materials.

Motion of the recording medium relative to the printhead during drop ejection can consist of keeping the printhead stationary and advancing the recording medium past the printhead while the drops are ejected, or alternatively keeping the recording medium stationary and moving the printhead. The former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. In a piezoelectric inkjet printing device, a wall of the pressure chamber includes a piezoelectric element that causes the wall to deflect into the ink-filled pressure chamber when a voltage pulse is applied, so that ink is forced through the nozzle. Piezoelectric inkjet has significant advantages in terms of chemical compatibility and ejection latitude with a wide range of inks (including aqueous-based inks, solvent-based inks, and ultraviolet-curing inks), as well as the ability to eject different sized drops by modifying the electrical pulse.

Piezoelectric printing devices also have technical challenges that need to be addressed. Because the amount of piezoelectric displacement per volt is small, the piezoelectric chamber wall area must be much larger than the nozzle area in order to eject useful drop volumes, so that each drop ejector is relatively large. The width of each drop ejector in a row of drop ejectors is limited by the nozzle spacing in that row. As a result, the pressure chambers typically have a length dimension that is much greater than the width dimension. Printing applications that require printing at high resolution and high throughput require large arrays of drop ejectors with nozzles that are closely spaced. Staggered rows of nozzles can provide dots at close spacing on the recording medium through appropriate timing of firing of each row of drop ejectors. However, with many staggered rows, the size of the piezoelectric printing device becomes large.

A further challenge is that, unlike thermal inkjet printing devices that typically include integrated logic and driving electronics so that the number of leads to the device is reduced, a piezoelectric printing device typically has individual electrical leads for each drop ejector that need to be connected to the driving electronics. In order to apply a voltage across the piezoelectric element independently for each drop ejector in order to eject drops when needed, each drop ejector needs to be associated with two electrodes. The two types of electrodes are sometimes called positive and negative electrodes, or individual and common electrodes for example.

Some types of piezoelectric printing devices are configured such that the two types of electrodes are on opposite surfaces of the piezoelectric element. For making electrical interconnection between the piezoelectric printing device and the driving electronics it can be advantageous to have the two types of electrodes on a same outer surface of the piezoelectric element.

U.S. Pat. No. 5,255,016 discloses a piezoelectric inkjet printing device in which positive and negative comb-shaped electrodes are formed on an outer surface of a piezoelectric plate. The teeth of the comb, at least in some regions, extend across the width of the drop ejector. A portion of the positive electrode extends along one side edge of the piezoelectric plate, and a portion of the negative electrode extends along an opposite side edge of the piezoelectric plate. Individual piezoelectric plates are provided for each drop ejector, resulting in a structure that would be unwieldy to manufacture with large arrays of drop ejectors at tight spacing.

U.S. Pat. No. 6,243,114 discloses a piezoelectric inkjet printing device in which the common electrode on an outer surface of the piezoelectric plate is comb-shaped with one electrode tooth extending along each side wall of the pressure chamber and a central common electrode tooth extending along the length of the pressure chamber. Two individual electrodes extend along the length of the pressure chamber on opposite sides of the central common electrode tooth.

U.S. Pat. No. 5,640,184 discloses a piezoelectric inkjet printing device in which pressure chambers for a row of nozzles extend alternately in opposite directions from the row of nozzles. A common electrode on a surface of the piezoelectric plate extends along the row of nozzles and has electrode teeth that extend alternately in opposite directions over the side walls of the pressure chambers. Interlaced between the electrode teeth of the common electrode is a spaced array of individual electrodes that are positioned directly over the pressure chambers. When a voltage is applied to an individual electrode, the piezoelectric plate is mechanically distorted in a shear mode toward the corresponding pressure chamber to cause ejection of an ink drop.

Chinese Patent Application Publication No. 107344453A discloses a piezoelectric inkjet printing device shown in FIGS. 1 and 2, which are taken from '453 with some additional labeling added to FIG. 1 for clarification. A substrate 100 includes a first side 101 in which a row of pressure chambers 110 is arranged. Each pressure chamber 110 is bounded by side walls 161 and 162. A channel 130 leads from pressure chamber 110 to a nozzle 132 that is disposed on a second side 102 of the substrate 100. The width of the pressure chamber 110 between side walls 161 and 162 is W. An ink groove 120 is fluidically connected to an end of each of the pressure chambers 110 in order to provide ink to them. A damping structure 140 including a plurality of pillars 141 is provided in each pressure chamber 110 between the ink groove 120 and the channel 130. A driving cover plate 200 includes a piezoelectric plate 210, made of lead zirconate titinate (PZT) for example. A first surface 211 of the piezoelectric plate 210 is bonded to the first side 101 of the substrate 100. An electrode layer 220 is disposed on an outer second surface 212 of the piezoelectric plate 210. The electrode layer 220 includes positive electrodes 221 that are each disposed over the length of the pressure chambers 110, as well as negative electrodes 222 that are disposed over the length of the side walls 161 and 162 between pressure chambers 110. An ink inlet port 230 is provided through the piezoelectric plate 210 to bring ink from an external ink supply to the ink groove 120 in the substrate 100. Nozzle 132 extends from a flow path 131 in silicon 310 through an oxide layer 320 and a nozzle layer 330 (FIG. 2).

It has been found that piezoelectric printing devices having both types of electrodes on an outer surface of a piezoelectric plate away from the pressure chamber have pressure chamber wall displacements that are highly dependent upon the thickness of the piezoelectric plate. For example, the integrated displacement of the plate wall can be a factor of ten higher for a plate thickness of 40 microns than for a plate thickness of 100 microns. By comparison, for piezoelectric printing devices having both types of electrodes on an inner surface of the piezoelectric plate proximate to the pressure chamber have an integrated displacement of the plate wall that is only 4% higher for a plate thickness of 40 microns than for a plate thickness of 100 microns. Moreover, the displacement for a plate thickness of 40 microns is more than twice as large if the electrodes are on the inner surface of the piezoelectric plate than if they are on the outer surface of the piezoelectric plate. As a result, drop ejector configurations having the electrodes on the inner surface of the piezoelectric plate can be operated at greater efficiency with lower voltage or smaller chamber dimensions. In addition the velocities and volumes of ejected drops are less sensitive to manufacturing variability in piezoelectric plate thickness, resulting in improved print quality.

What is needed is a piezoelectric printing device configuration to facilitate electrical interconnection directly to the electrodes disposed on the inner surface of the piezoelectric plate. Furthermore, what is needed is a configuration of rows of drop ejectors on the piezoelectric printing device in a space-efficient manner that can provide ejection of drops for high printing resolution and fast printing throughput.

SUMMARY OF THE INVENTION

According to an aspect of the present invention, a piezoelectric printing device includes a substrate and a piezoelectric plate. An array of at least one row of drop ejectors is disposed on the substrate, such that each row is aligned along a row direction. Each drop ejector includes a pressure chamber. The pressure chamber, which is disposed on a first side of the substrate, is bounded by a first side wall and a second side wall. Each drop ejector also includes a nozzle that is in fluidic communication with the pressure chamber. The piezoelectric plate has a first surface that is disposed proximate to the first side of the substrate. A bonding layer is disposed between the piezoelectric plate and the substrate. An electrode layer is disposed between the first surface of the piezoelectric plate and the bonding layer. The electrode layer includes a signal line corresponding to each pressure chamber, such that each signal line leads to a signal input pad. The electrode layer also includes ground traces disposed on both sides of each pressure chamber, such that the ground traces are electrically connected to at least one common ground bus that is electrically connected to at least one ground return pad.

This invention has the advantage that the electrodes are configured to enable high efficiency of drop ejection with reduced variability of drop volume and drop velocity. In addition, the electrical lines of the piezoelectric printing device and their corresponding connection pads are configured for compact and reliable electrical interconnection to a printhead package. A further advantage is that the piezoelectric drop ejectors are configured in a space efficient manner and are capable of high printing resolution and fast printing throughput.

BRIEF DESCRIPTION OF THE DRAWINGS

FIG. 1 shows an exploded perspective view of a prior art piezoelectric drop ejector array configuration;

FIG. 2 shows a cross-section of a single drop ejector of the type shown in FIG. 1;

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense. Words such as "over", "under", "above" or "below" are intended to describe positional relationships of features that are in different planes, but it is understood that a feature of a device that is "above" another feature of the device in one orientation would be "below" that feature if the device is turned upside down.

Figure 3A:
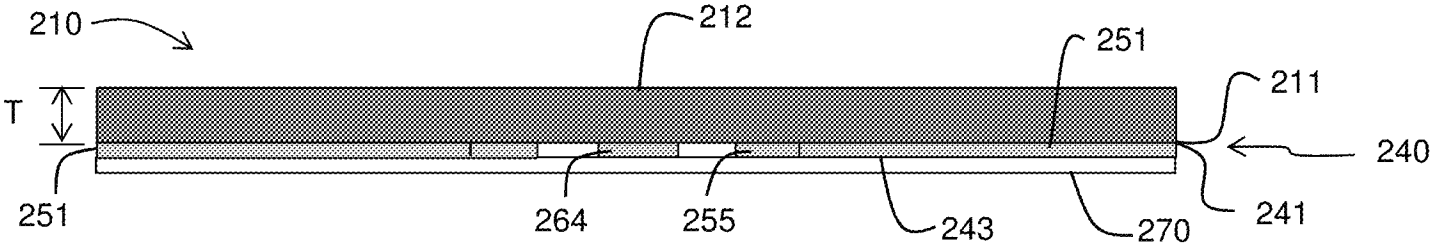
FIG. 3A shows a cross-section of a portion of a piezoelectric plate according to an embodiment.
Figure 3B:
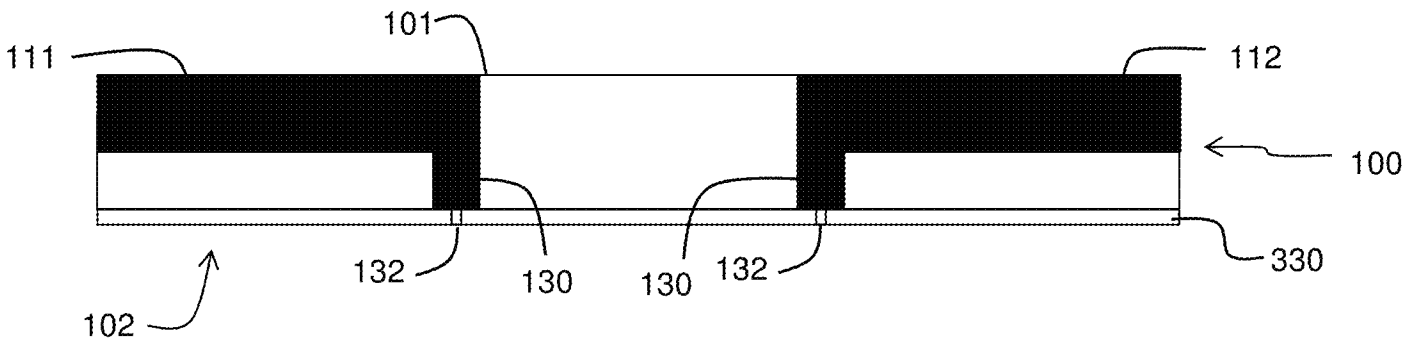
FIG. 3B shows a cross-section of a corresponding portion of a substrate.
Figure 5:
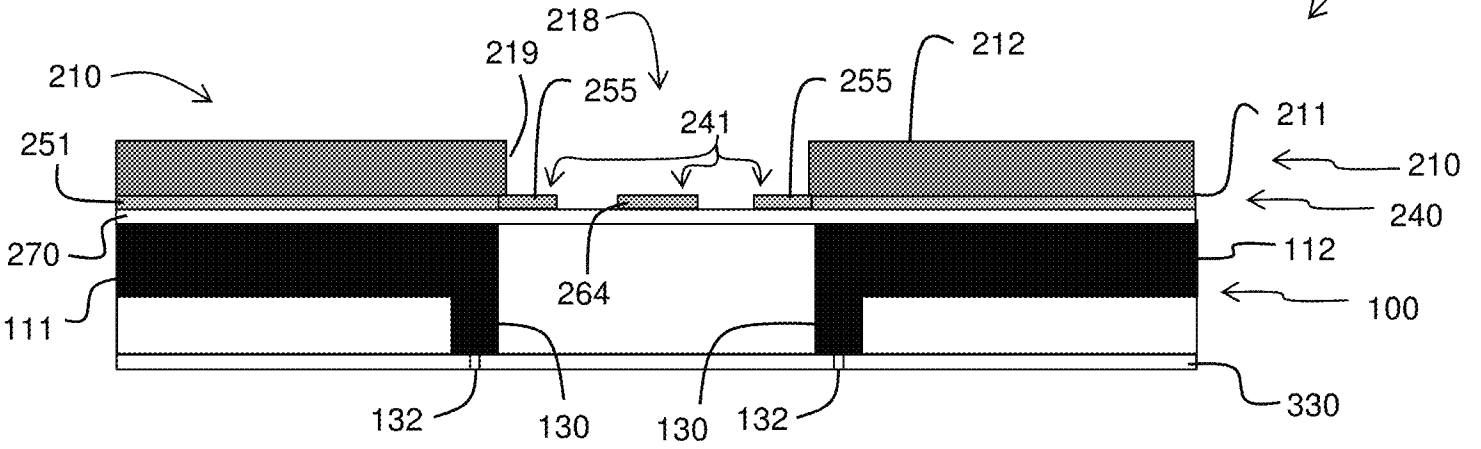
FIG. 5 shows a cross-section similar to FIG. 4 after an opening in the piezoelectric plate has been formed.
Figure 11:
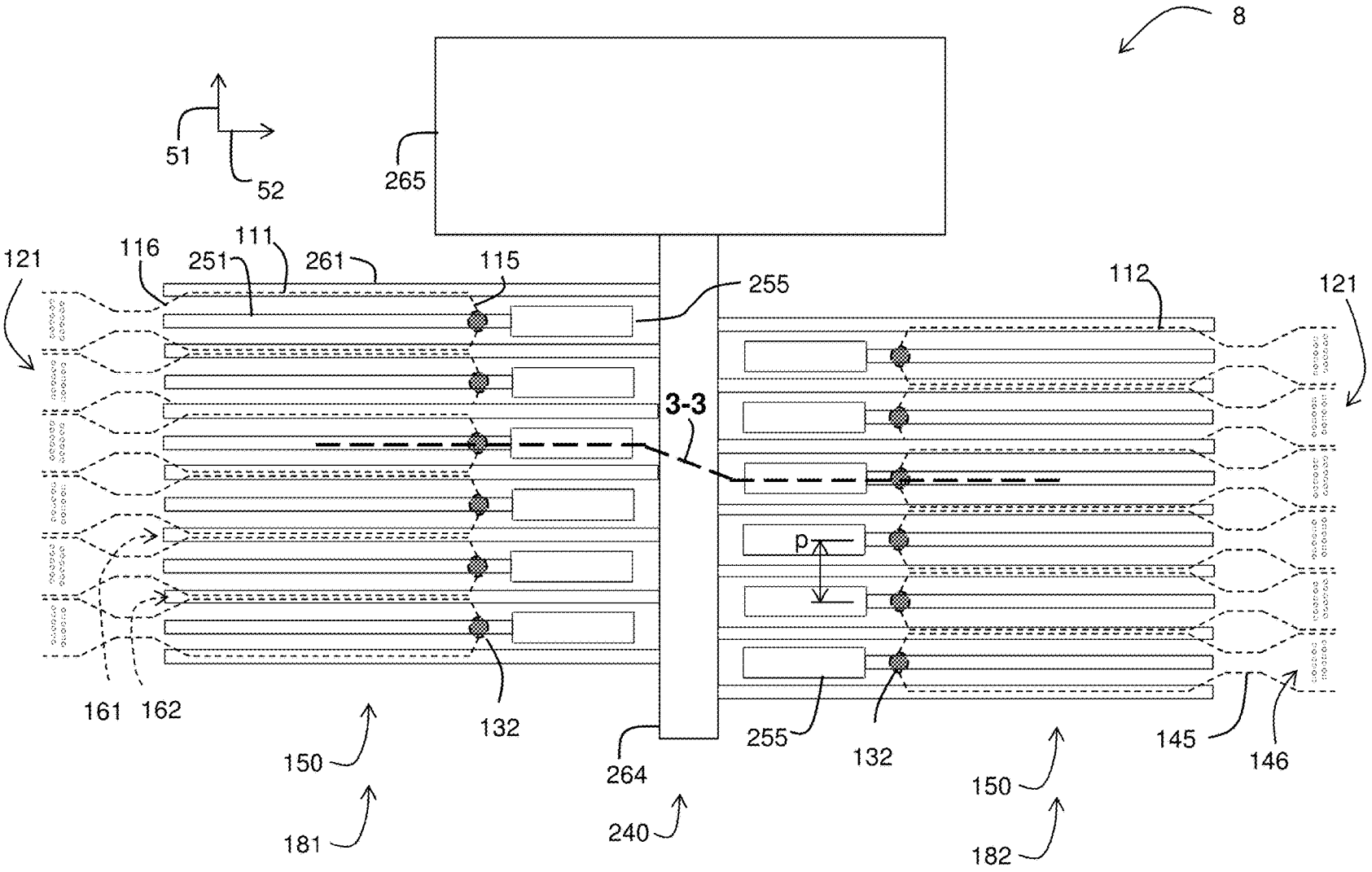
FIG. 11 shows a top view of a portion of a piezoelectric printing device according to an embodiment.

FIG. 3A shows a cross-section of a piezoelectric plate 210 through dashed line 3-3 of FIG. 11. FIG. 3B shows a corresponding portion of a substrate 100. Herein what is generically meant by a piezoelectric plate is a discrete element that is assembled onto a substrate rather than a thin film that is deposited onto a substrate. Piezoelectric plate 210 has a thickness T between inner first surface 211 and outer second surface 212. Substrate 100 includes a pair of pressure chambers 111 and 112, which extend outwardly from a central region. Each pressure chamber 111 and 112 includes a channel 130 that leads to a nozzle 132 disposed in a nozzle layer 330. An electrode layer 240 is disposed on the first surface 211 of piezoelectric plate 210. Electrode layer 240 includes signal lines 251 that extend over pressure chambers 111 and 112 in the assembled piezoelectric printing device 8 (FIG. 5). Signal lines 251 lead to corresponding signal input pads 255. Electrode layer 240 also includes at least one common ground bus 264 and at least one ground return pad 265 (FIG. 11). Electrode layer 240 is disposed between inner first surface 211 of the piezoelectric plate 210 and a bonding layer 270. The bonding layer 270 can be a polymer adhesive, for example. Bonding layer 270 joins piezoelectric plate 210 to the first side 101 of substrate 100 in the assembled piezoelectric printing device 8 (FIG. 5). In addition, bonding layer 270 isolates the ink in pressure chambers 111 and 112 from the electrical lines and the piezoelectric plate 210. In the example shown in FIG. 3A a first interfacial surface 241 of electrode layer 240 is adjacent to inner first surface 211 of piezoelectric plate 210. An electrode second surface 243 of electrode layer 240 is adjacent to bonding layer 270.

Figure 4:
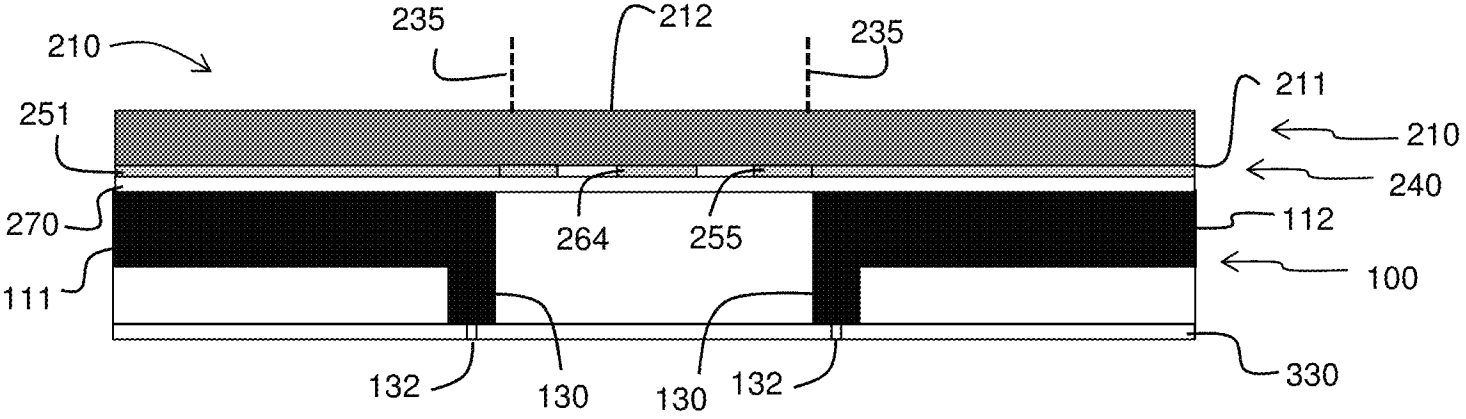
FIG. 4 shows a cross-section similar to those of FIGS. 3A and 3B after the piezoelectric plate is bonded to the substrate.

FIG. 4 shows a cross-section similar to the cross-sections shown in FIGS. 3A and 3B after the piezoelectric plate 210 has been bonded to the substrate 100 by bonding layer 270. Also shown in FIG. 4 are boundary markers 235 that define the location of walls 219 of an opening 218 in the piezoelectric plate 210 of the assembled piezoelectric printing device 8 (FIG. 5). Opening 218 can be formed by etching the piezoelectric plate 210 from outer second surface 212 toward inner first surface 211, for example. In that case, boundary markers 235 can correspond to the edges of an etch mask on outer second surface 212. Opening 218 exposes the first interfacial surface 241 of a region of electrode layer 240 corresponding to signal input pads 255, common ground bus 264 and ground return pad 265 (FIG. 11). In other words, a portion of the first interfacial surface 241 of the electrode layer 240 is exposed through the opening 218. In some embodiments, ground return pad 265 can be exposed through a separate opening (not shown) from opening 218. Electrical connection can be made to the first interfacial surface 241 of electrode layer 240 corresponding to signal input pads 255 and ground return pad 265 using a U-shaped flexible wiring element having a device connection region that extends through opening 218 as described in further detail in patent application Ser. No. 16/912,791, entitled: "Piezoelectric printhead and printing system", and patent application Ser. No. 16/912,833, entitled: "Piezoelectric printhead for multiple inks and printing system".

Figure 6A:
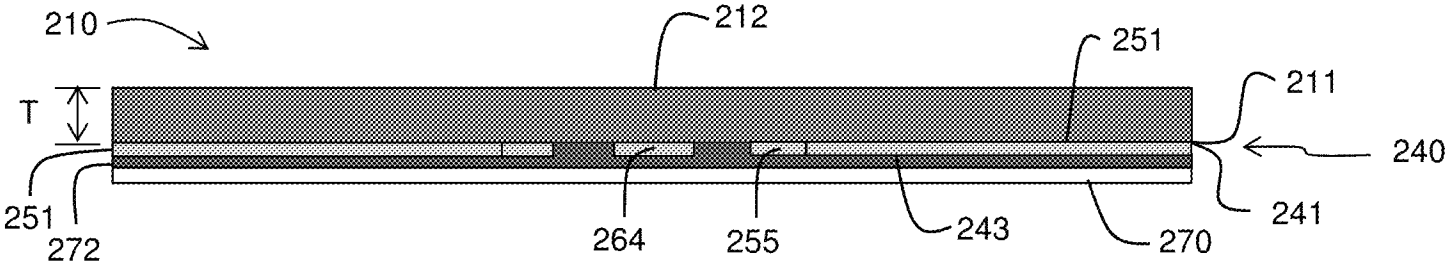
FIG. 6A shows a cross-section of a portion of a piezoelectric plate according to another embodiment.
Figure 7:
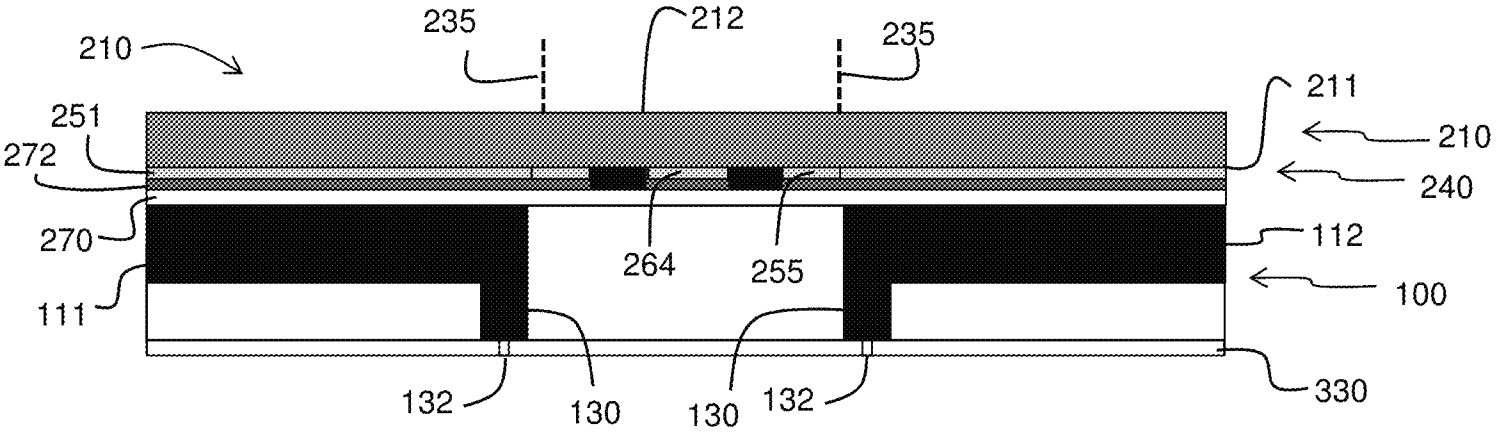
FIG. 7 shows a cross-section similar to those of FIGS. 6A and 6B after the piezoelectric plate is bonded to the substrate.
Figure 8:
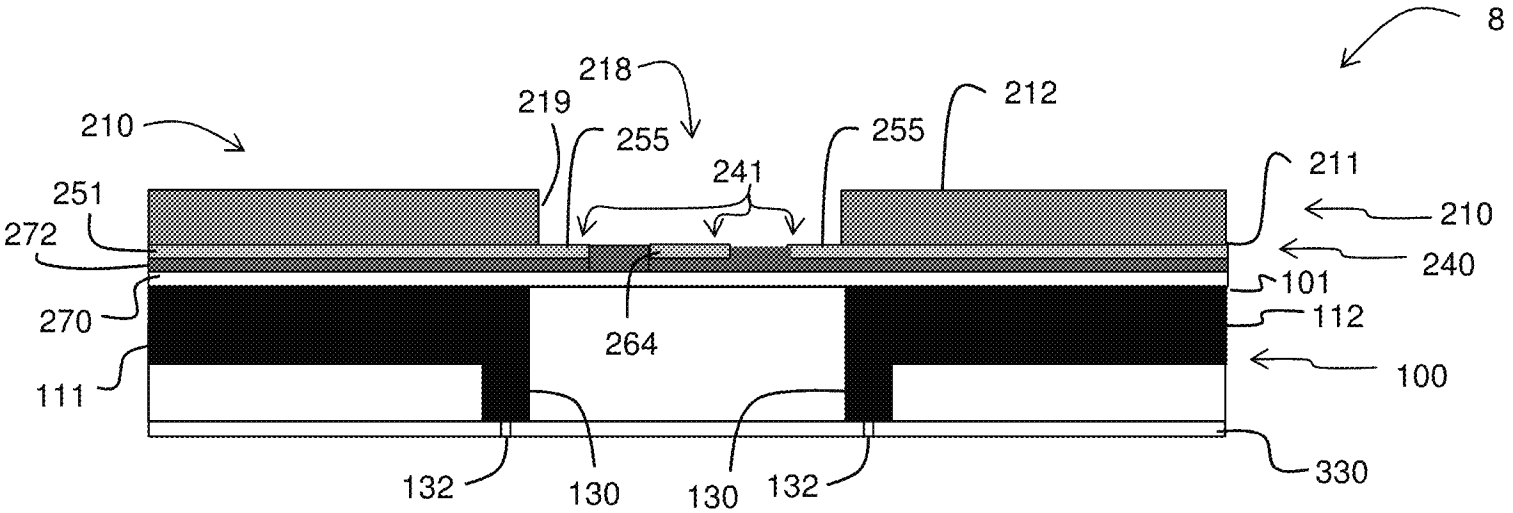
FIG. 8 shows a cross-section similar to FIG. 7 after an opening in the piezoelectric plate has been formed.

In some embodiments an additional intermediate insulating layer 272 can be added between the bonding layer 270 and the piezoelectric plate 210 (as shown in FIGS. 6A, 7 and 8), or between the bonding layer 270 and the first side 101 of the substrate 100 for improved reliability. In particular, the intermediate insulating layer 272 can improve adhesion and protection of the electrode layer 240, especially during the process of forming the opening 218 in the piezoelectric plate 210. The intermediate insulating layer 272 can be silicon oxide or silicon nitride, for example.

Figure 6B:
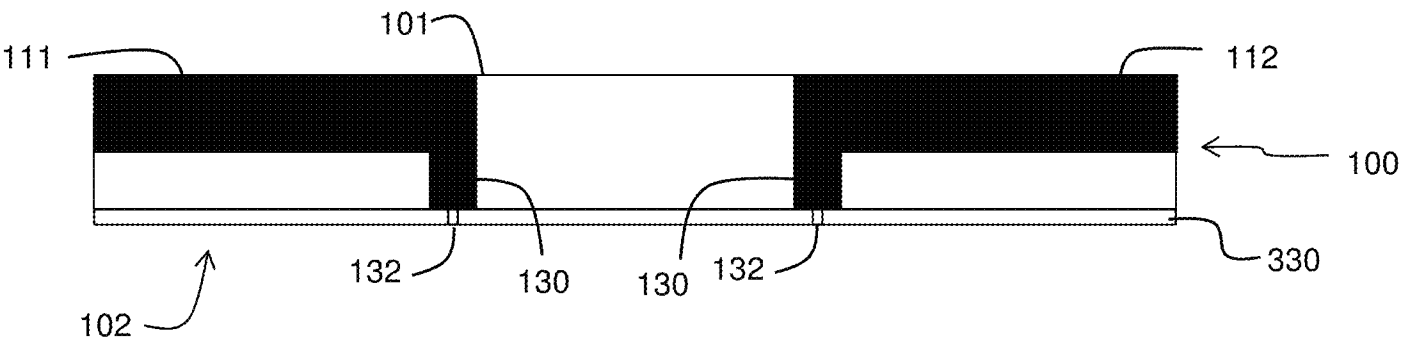
FIG. 6B shows a cross-section of a corresponding portion of a substrate.

Specifically, the example shown in FIG. 6A is similar to FIG. 3A described above with the addition of intermediate insulating layer 272 disposed between electrode layer 240 and bonding layer 270. FIG. 6B is the same as FIG. 3B. FIGS. 7 and 8 are similar to FIGS. 4 and 5 described above with the addition of insulating layer disposed between electrode layer 240 and bonding layer 270.

Figure 9A:
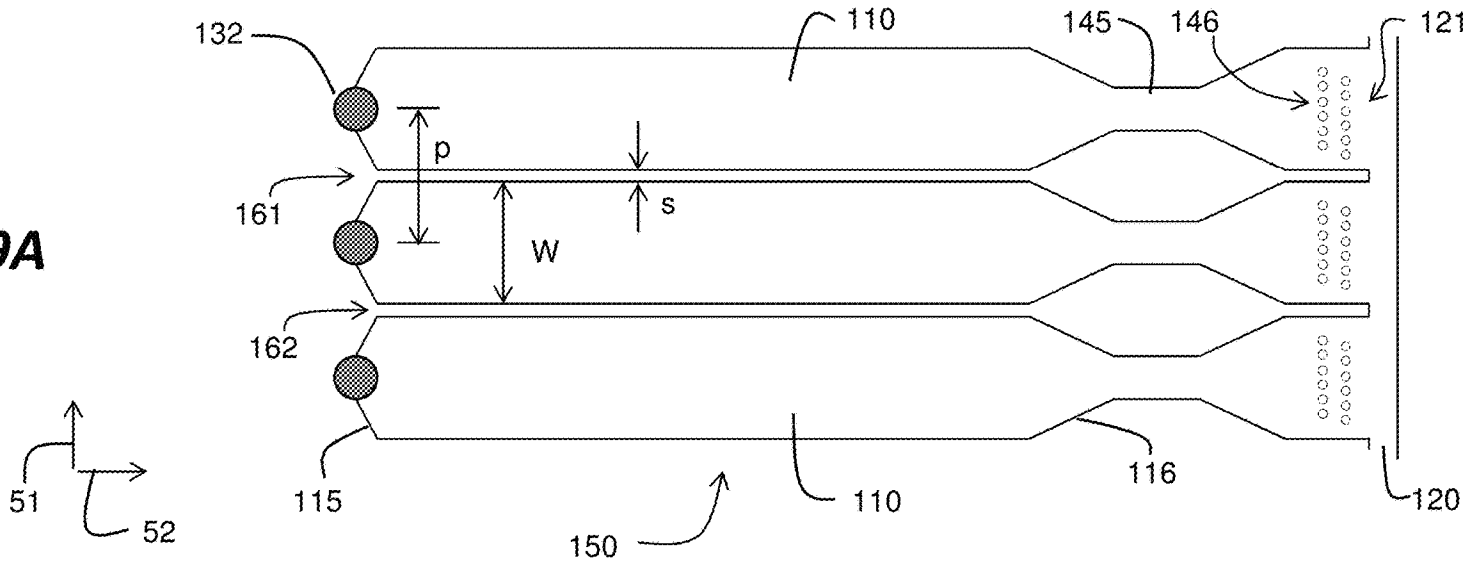
FIG. 9A shows a top view of three drop ejectors in a substrate.

FIG. 9A shows a top view of a row of three drop ejectors 150 formed on a substrate 100 (FIG. 3B), each drop ejector 150 including a pressure chamber 110 and a nozzle 132. Nozzles 132 (as well as drop ejectors 150) are aligned along a row direction 51 and the centers of adjacent nozzles are spaced at a pitch p. Pressure chambers 110 have a width W along the row direction 51 and are bounded by side walls 161 and 162, each having a wall width s, such that W+s=p. In order to provide sufficiently large area of the pressure chamber 110, it is advantageous to have W greater than 0.8p in many embodiments. In other words, typically s is less than 0.2p. The nozzle 132 is disposed near a first end 115 of the pressure chamber 110. In the example shown in FIG. 9A, ink enters the pressure chamber 110 from ink groove 120 (connected to an ink inlet port 230 as in FIGS. 1 and 2), through ink inlet 121, through filter 146 and through restrictor 145 near second end 116 of pressure chamber 110 opposite the first end 115. Ink groove 120 provides ink to a plurality of pressure chambers 110. In other examples described below, ink enters ink inlets 121 directly from an edge of the substrate 100. Filter 146 can include pillars similar to the pillars 141 shown in prior art FIG. 1. Restrictor 145 provides flow impedance (as does filter 146) to help limit the flow of ink toward inlet 121 when a drop of ink is being ejected from pressure chamber 110, thereby directing more of the pressure of the deflecting piezoelectric plate to propelling the drop of ink.

Figure 9B:
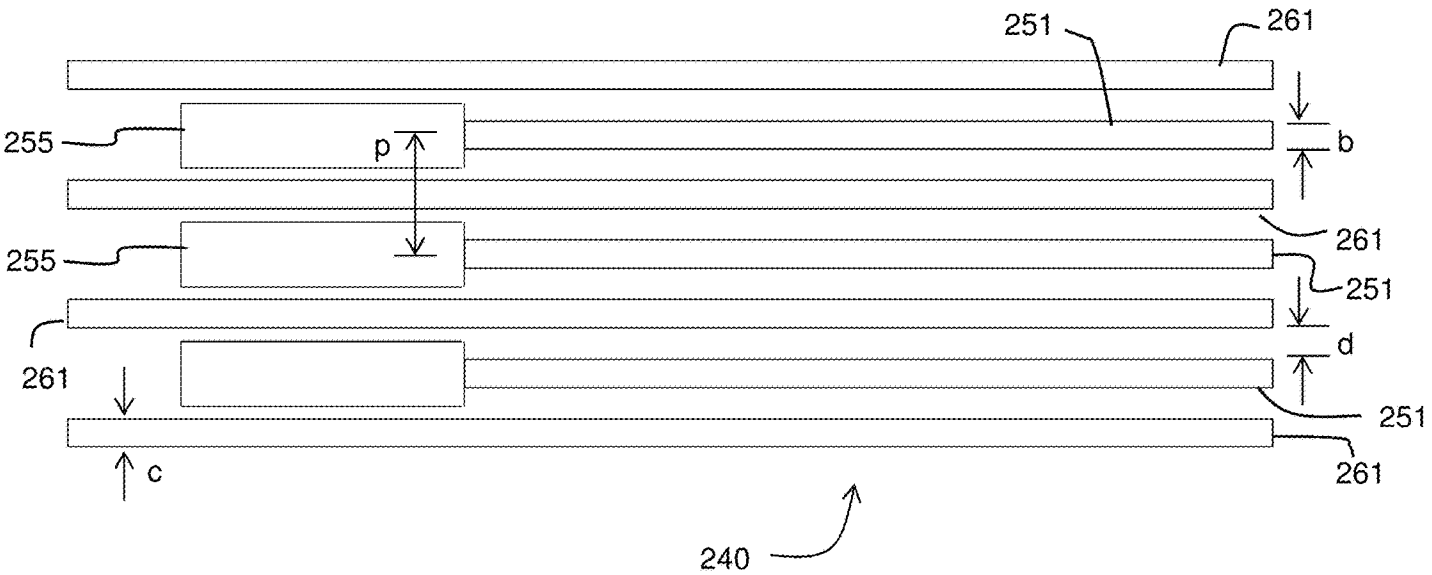
FIG. 9B shows a top view of electrical lines on a piezoelectric plate corresponding to the drop ejectors shown in FIG. 9A.
Figure 10:
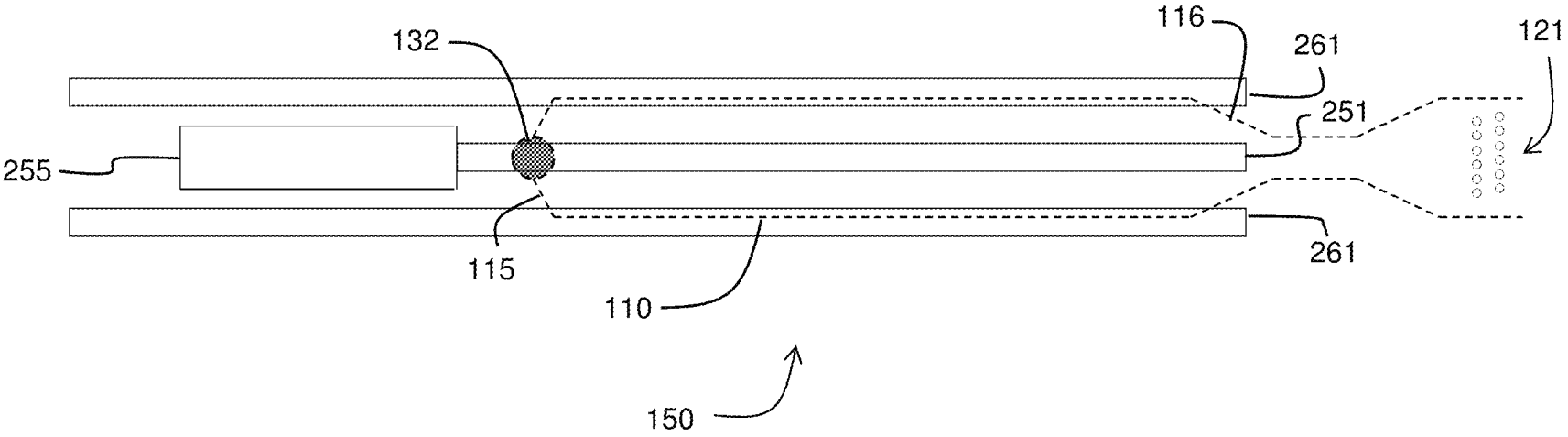
FIG. 10 shows a top view of a single drop ejector and its corresponding electrical lines.

FIG. 9B shows a top view of electrical lines corresponding to the drop ejectors 150 shown in FIG. 9A. The electrical lines are provided as part of electrode layer 240 disposed on inner first surface 211 of piezoelectric plate 210 (FIG. 5). Widths and spacings of electrical lines are configured for efficient driving of the piezoelectric plate 210. FIG. 10 shows a top view of a single drop ejector 150 (dashed lines) that is disposed in a substrate 100 below the corresponding electrical lines disposed on the piezoelectric plate 210 in order to show spatial relationships. A signal line 251 is disposed over each corresponding pressure chamber 110 and extends in a direction 52 that is perpendicular to the row direction 51. In the example shown in FIG. 10, signal line 251 is disposed over a center of the corresponding pressure chamber 110. Each signal line leads to a corresponding signal input pad 255. Nozzle 132 is disposed near a first end 115 of the pressure chamber 110 proximate to the signal input pad 255. With reference to FIGS. 9A and 9B, signal line 251 has a width b that is greater than 0.1 times the width W of the pressure chamber 110. Signal line width b is also greater than 0.2 times the thickness T of the piezoelectric plate 210 (FIG. 3A). Ground traces 261 are aligned over the first side wall 161 and the second side wall 162. Ground traces are typically disposed midway between corresponding pressure chambers 110 and extend in a direction 52 that is perpendicular to row direction 51. Ground trace 261 has a width c that is greater than the width s of side walls 161 and 162 in many embodiments. A distance d between a signal line 251 and an adjacent ground trace 261 is typically greater than 0.1 W. A distance d between a signal line 251 and an adjacent ground trace 261 is typically greater than 0.5 T and less than 2T.

Figure 16:
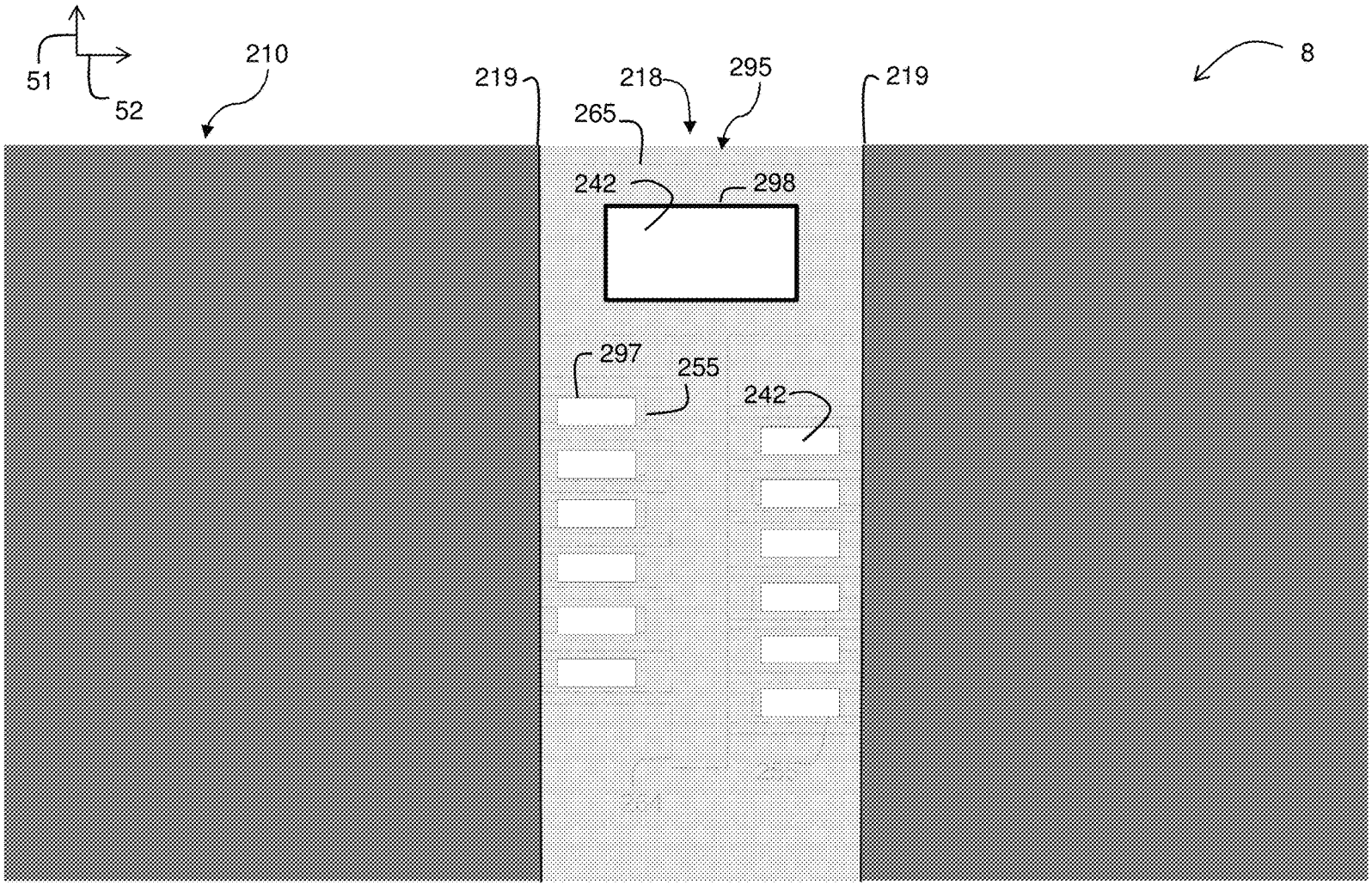
FIG. 16 shows a top view of the piezoelectric printing device shown in FIG. 15.

FIG. 11 shows a top view of a portion of a piezoelectric printing device 8 according to an embodiment of the invention. A pair of staggered rows 181 and 182 of drop ejectors 150 (similar to those described above with reference to FIGS. 5, 8 and 10) is disposed on the substrate 100 (FIGS. 5 and 8). Each row is aligned along row direction 51. First row 181 and second row 182 are spaced apart from each other along a direction 52 that is perpendicular to row direction 51. Each drop ejector 150 in first row 181 includes a pressure chamber 111 and each drop ejector in second row 182 includes a pressure chamber 112 that is disposed on a first side 101 of the substrate 100. In the example shown in FIG. 11, ink is fed into the ink inlets 121 of each drop ejector 150 directly from the edges of substrate 100 that extend along row direction 51. The pressure chambers 111 and 112 are bounded by a first side wall 161 and a second side wall 162. Each drop ejector also includes a nozzle 132 that is in fluidic communication with the corresponding pressure chamber 111 or 112. The nozzles 132 are disposed in a nozzle layer 330 on a second side 102 of the substrate 100. An electrode layer 240 disposed on an inner first surface 211 of a piezoelectric plate 210 (FIG. 3A) includes a signal line 251 corresponding to each drop ejector 150 in each of the staggered rows 181 and 182 of drop ejectors 150. Each signal line 251 leads to a corresponding signal input pad 255 that is disposed between the staggered rows 181 and 182 of drop ejectors 150. The electrode layer 240 also includes at least one common ground bus 264 that is connected to ground traces 261 that are aligned over the first and second side walls 161 and 162 of each pressure chamber. The common ground bus 264 extends along the row direction 51 and leads to a ground return pad 265. In the example shown in FIG. 11, the common ground bus 264 is disposed between the signal input pads 255 of the first staggered row 181 of drop ejectors 150 and the signal input pads 255 of the second staggered row 182 of drop ejectors 150. The configuration of signal input pads 255 and ground return pad 265 is advantageous for providing electrical interconnection from piezoelectric printing device 8 in a compact region to a printhead package (not shown). In order to provide more reliable electrical interconnection without shorts, an electrically insulating masking layer with windows (similar in pattern shown in FIG. 16) can be used for exposing the signal input pads 255 and ground return pads 265 for electrical interconnection in the embodiment of FIG. 11.

The nozzles 132 in row 181 are spaced at pitch p, and the nozzles 132 in row 182 are also spaced at pitch p. The two rows are offset by a distance p/2 along the row direction 51. As a result, if a recording medium (not shown) is moved relative to piezoelectric printing device 8 along direction 52, ejecting ink drops by the drop ejectors in row 181 at a suitable timing relative to ejecting ink drops by the drop ejectors in row 182 can print a composite row of dots on the recording medium with a dot spacing of p/2. It is preferable to have a small printing region on the piezoelectric printing device 8, i.e. a relatively short distance between the nozzles 132 in row 181 and the nozzles 132 in row 182 along direction 52. In order to accomplish this, the drop ejectors 150 in rows 182 are oppositely oriented, such that the nozzles 132 of the first staggered row 181 are proximate to the nozzles 132 of the second row, and such that the pressure chambers 111 of the first row 181 and the pressure chambers 112 of the second row 182 extend in opposite directions along direction 52 from their respective nozzles 132. The printing region can be further reduced on the piezoelectric printing device 8 in the embodiment shown below in FIG. 17.

Figure 12A:
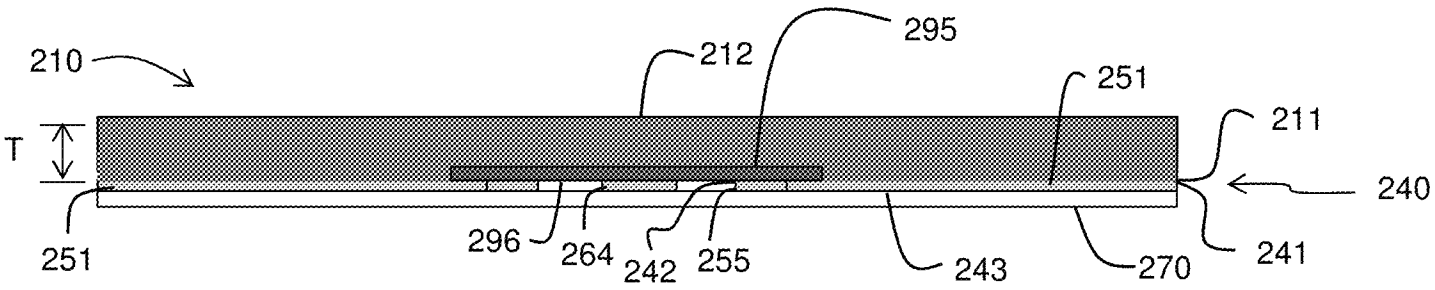
FIG. 12A shows a cross-section of a portion of a piezoelectric plate according to an additional embodiment.
Figure 12B:
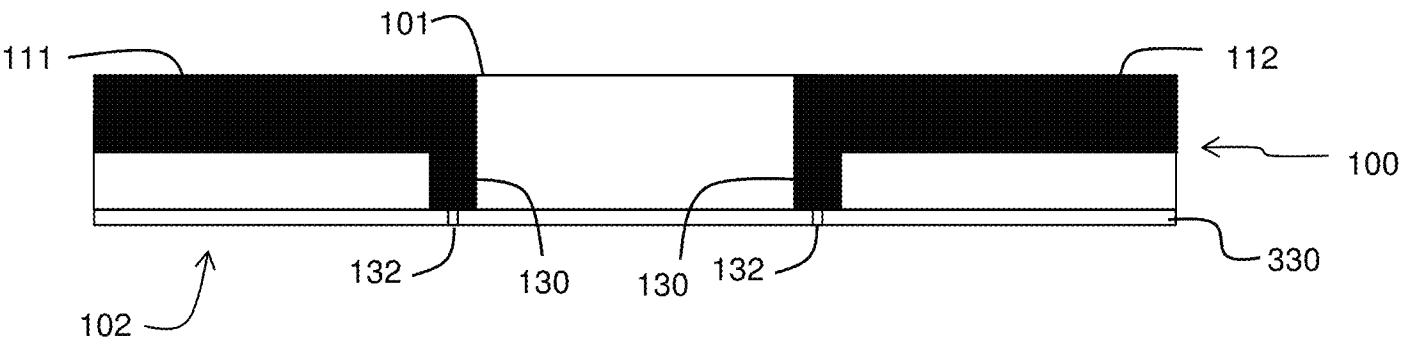
FIG. 12B shows a cross-section of a corresponding portion of a substrate.

FIG. 12A shows a cross-section (similar to that shown in FIG. 3A) of another embodiment of a piezoelectric plate 210 and electrode layer 240. FIG. 12B is a cross-section (same as that shown in FIG. 3B) of the corresponding portion of substrate 100. In the example shown in FIG. 12A, a shallow trench, formed for example by etching, is disposed in the inner first surface 211 of piezoelectric plate 210. The shallow trench is filled with an insulating layer 295 such as silicon oxide or silicon nitride. Excess insulating material from insulating layer 295 that was deposited on inner first surface 211 beyond the trench can be removed by chemical mechanical polishing, for example. A surface 296 of the insulating layer is thereby substantially flush (i.e. within two microns) with the inner first surface 211 of the piezoelectric plate 210. In this embodiment, electrode layer 240 extends across inner first surface 211 of piezoelectric plate 210 and surface 296 of insulating layer 295. Electrode layer 240 is then patterned to form the signal lines 251 and ground traces 261 (FIG. 11) primarily on the inner first surface 211 of the piezoelectric plate, and to form the signal input pads 265, common ground bus 264 and ground return pad 265 (FIG. 11) on the surface 296 of insulating layer 295. In the example shown in FIG. 12A, a region of first interfacial surface 241 of electrode layer 240 is disposed between signal input lines 251 and the first surface 211 of the piezoelectric plate 210. A region of a second interfacial surface 242 of electrode layer 240 is disposed between the signal input pads 255 and the surface 296 of the insulating layer 295.

Figure 13:
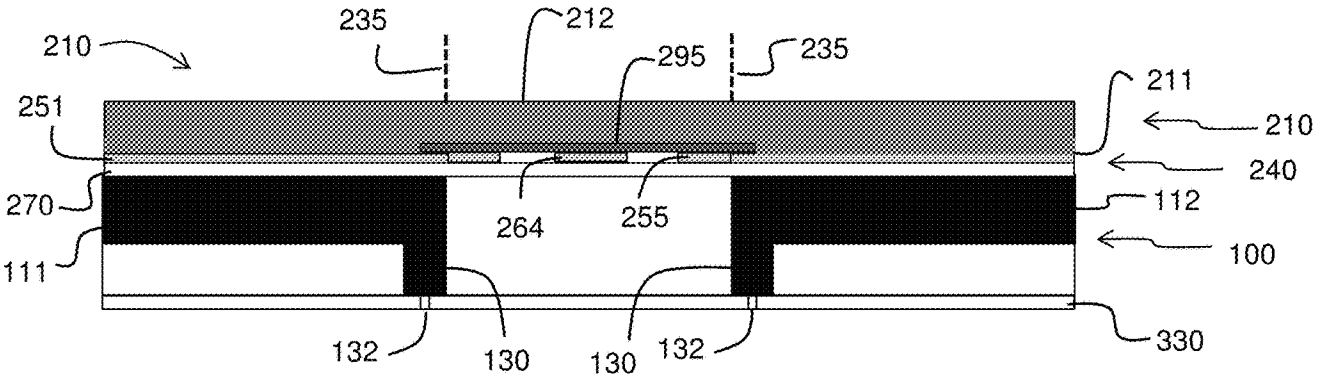
FIG. 13 shows a cross-section similar to those of FIGS. 12A and 12B after the piezoelectric plate is bonded to the substrate.
Figure 14:
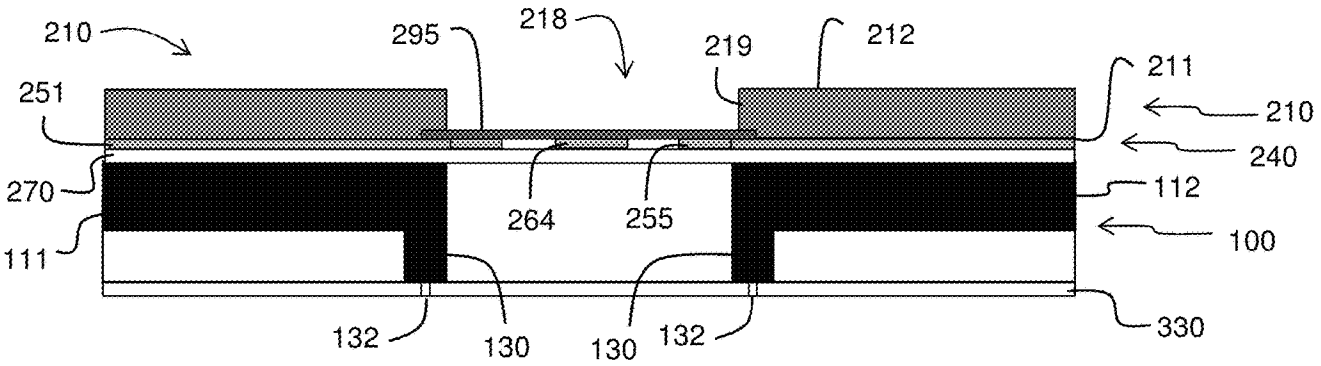
FIG. 14 shows a cross-section similar to FIG. 13 after an opening in the piezoelectric plate has been formed.
Figure 15:
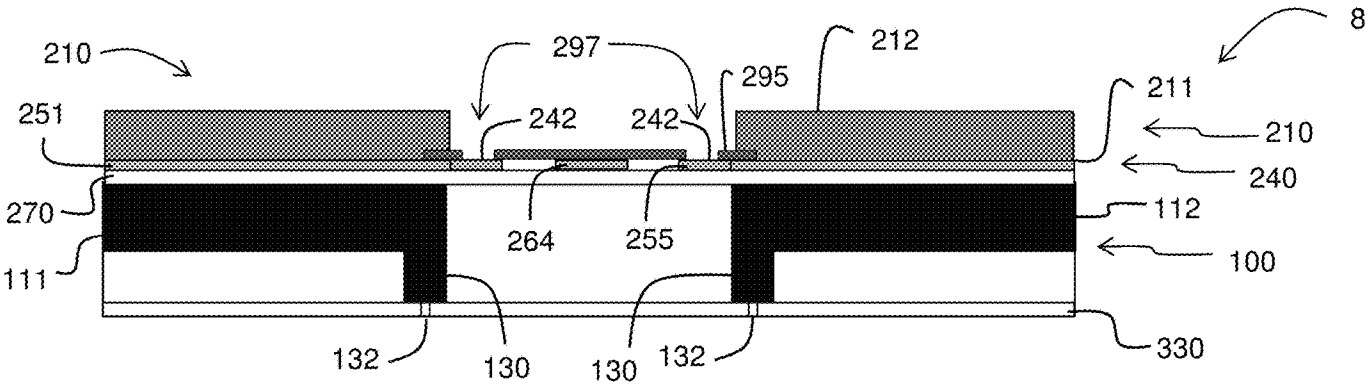
FIG. 15 shows a cross-section similar to FIG. 14 after windows have been formed in an insulating layer to expose signal input pads.

FIG. 13 shows a cross-section similar to the cross-sections shown in FIGS. 12A and 12B after the piezoelectric plate 210 has been bonded to the substrate 100 by bonding layer 270. Also shown in FIG. 13 are boundary markers 235 that define the location of walls 219 of an opening 218 in the piezoelectric plate 210 of the assembled piezoelectric printing device (FIG. 14). Opening 218 can be formed by etching the piezoelectric plate 210 from outer second surface 212 toward inner first surface 211, for example. In that case, boundary markers 235 can correspond to the edges of an etch mask on outer second surface 212. Opening 218 exposes the insulating layer 295. FIG. 15 is similar to FIG. 14 and shows windows 297 that have been formed in insulating layer 295 to expose second interfacial surface 242 of the region of electrode layer 240 corresponding to signal input pads 255. Optionally there can also be a window (not shown) in insulating layer 295 exposing the second interfacial surface 242 of the region of electrode layer 240 corresponding to common ground bus 264. As shown in the top view of FIG. 16, there is also a window 298 in insulating layer 295 exposing the second interfacial surface 242 of a region of electrode layer 240 corresponding to ground return pad 265. In other words, a portion of the second interfacial surface 242 of the electrode layer 240 is exposed through the opening 218 and through the windows 297 and 298. Electrical connection can be made to the signal input pads 255 and ground return pad 265 at second interfacial surface 242 using a U-shaped flexible wiring element having a device connection region that extends through opening 218 as described in further detail in patent application Ser. No. 16/912,791, entitled: "Piezoelectric printhead and printing system", and patent application Ser. No. 16/912,833, entitled: "Piezoelectric printhead for multiple inks and printing system".

Figure 17:
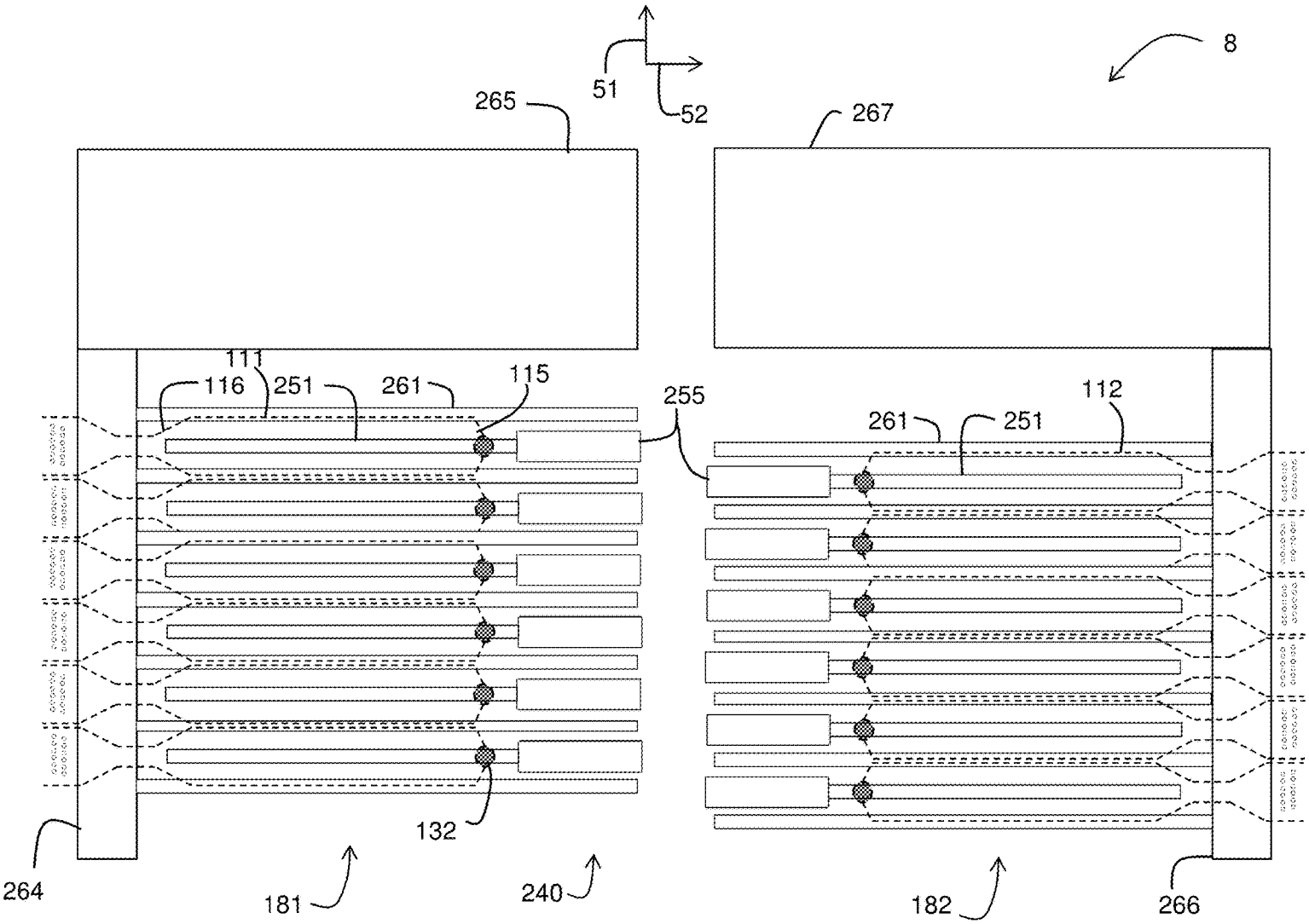
FIG. 17 shows a top view of a portion of a piezoelectric printing device according to another embodiment.

FIG. 17 shows a top view of a portion of a piezoelectric printing device 8 according to another embodiment of the invention. The configuration shown in FIG. 17 is similar to that shown in FIG. 11, except for the positions of the common ground bus 264 and the ground return pad 265. In the embodiment shown in FIG. 17, a first common ground bus 264 is disposed proximate to the second end 116 of the corresponding pressure chambers 111 in first row 181, and a second common ground bus 266 is disposed proximate to the second end 116 of the corresponding pressure chambers 112 in second row 182. The signal input pads 255 are disposed proximate to the first ends 115 of the pressure chambers 111 and 112 in rows 181 and 182, as they were in the FIG. 11 embodiment. First common ground bus 264 leads to a first ground return pad 265, and second common ground bus 266 leads to a second ground return pad 267. The similar patterning of windows 297 and 298 in insulating layer 295 shown in FIG. 16 can be used for exposing the signal input pads and ground return pads 266 and 267 for electrical interconnection in the embodiment of FIG. 17. In other embodiments (not shown) ground return pads 265 and 267 can be extended further toward the center so that they merge into a single ground return pad.

The drop ejectors 150 and electrical lines described above with reference to FIGS. 3-17 are well suited for a piezoelectric plate 210 that is configured to cause local deflection of the piezoelectric plate 210 into one or more pressure chambers 110/111/112 when a voltage pulse is applied to the electrodes corresponding to those pressure chambers 110/111/112 in order to eject a drop of ink. For such applications, the piezoelectric plate 210 is poled along a direction that is normal to first surface 211. For efficient deflection of the piezoelectric plate 210 of thickness T into a pressure chamber 110/111/112 having a width W, it is advantageous for T to be less than 0.5 W, and in some embodiments for T to be less than 0.3 W.

In an exemplary embodiment, the pitch p in each row is 0.01 inch, so that the nozzles 132 in each row are disposed at 100 nozzles per inch and a composite row of dots can be printed at 200 dots per inch by the pair of rows. For a pitch p=0.01 inch=254 microns a chamber width W can be 224 microns and a side wall width s can be 30 microns, for example. It is advantageous for a discrete piezoelectric plate 210 to have a thickness of around 50 microns, so that it is not too fragile. In such an example, T 0.22 W. It can be seen from FIGS. 9A and 9B that nozzle pitch p is equal to the width b of signal line 251 plus the width c of ground trace 261 plus twice the distance d between signal line 251 and ground trace 261, i.e. p=b+c+2d. In an example, width b of signal line 251 is 90 microns, width c of ground trace 261 is 90 microns and distance d is 37 microns. For the example where W=224 microns and d=37 microns, the distance d between a signal line 251 and an adjacent ground trace 261 is greater than 0.1 W. In addition in this example, the width b of signal line 251 is greater than 0.1 W. Further, for a thickness T of the piezoelectric plate 210 of 50 microns, the distance d=37 microns between a signal line 251 and an adjacent ground trace 261 is greater than 0.5 T and less than 2 T, and the width b of a signal line 251 is greater than 0.2 T.

In the embodiments described above there has been a single pair of staggered rows 181 and 182 of drop ejectors 150. In other embodiments (not shown) there can be additional pairs of staggered rows of drop ejectors that can be used to provide higher printing resolution or increased ink coverage, or can eject different types of ink (such as different colors of ink) for each pair of staggered rows, or can eject different ranges of drop sizes for each pair of staggered rows.

The invention has been described in detail with particular reference to certain preferred embodiments thereof, but it will be understood that variations and modifications can be effected within the spirit and scope of the invention.

The invention claimed is:

1. A piezoelectric printing device comprising:

a substrate;

an array of at least one row of drop ejectors, each row being aligned along a row direction, each drop ejector including:

a pressure chamber having a width W along the row direction disposed on a first side of the substrate, the pressure chamber being bounded by a first side wall and a second side wall; and a nozzle disposed in a nozzle layer that is formed on a second side of the substrate opposite to the first side;

a piezoelectric plate having a thickness T between an inner first surface that is disposed proximate to the first side of the substrate and an outer second surface that is opposite the inner first surface;

a bonding layer disposed between the piezoelectric plate and the substrate;

an electrode layer disposed between the inner first surface of the piezoelectric plate and the bonding layer, wherein the electrode layer includes:

a signal line corresponding to each pressure chamber, each signal line leading to a signal input pad; and ground traces disposed on both sides of each pressure chamber, the ground traces being electrically connected to at least one common ground bus that is electrically connected to at least one ground return pad.

2. The piezoelectric printing device of claim 1, wherein each signal input pad is exposed through an opening in the piezoelectric plate and each ground return pad is exposed through the opening in the piezoelectric plate.

3. The piezoelectric printing device of claim 1, wherein a portion of an interfacial surface of the electrode layer is exposed through an opening in the piezoelectric plate.

4. The piezoelectric printing device of claim 3, wherein the interfacial surface is adjacent to the inner first surface of the piezoelectric plate.

5. The piezoelectric printing device of claim 1, the piezoelectric plate including:

a trench; and an insulating material having a surface that is substantially flush with the inner first surface of the piezoelectric plate.

6. The piezoelectric printing device of claim 5, wherein the electrode layer extends across the inner first surface of the piezoelectric plate and the surface of the insulating material.

7. The piezoelectric printing device of claim 6, wherein the signal input pads and the ground return pads are exposed through an opening in the piezoelectric plate and through windows in the insulating material.

8. The piezoelectric printing device of claim 1, the array including at least one pair of staggered rows of drop ejectors including a first staggered row and a second staggered row, wherein the at least one common ground bus is disposed between the signal input pads of the first staggered row and the signal input pads of the second staggered row.

9. The piezoelectric printing device of claim 1, wherein the signal input pads are disposed proximate to a first end of the corresponding pressure chambers and the at least one common ground bus is disposed proximate to a second end of the corresponding pressure chambers opposite to the first end.

10. The piezoelectric printing device of claim 1, wherein the nozzle is disposed near a first end of the pressure chamber that is proximate to the signal input pad.

11. The piezoelectric printing device of claim 10, wherein each drop ejector further includes an ink inlet that is in fluidic communication with the pressure chamber, and wherein the ink inlet is disposed near a second end of the pressure chamber opposite the first end.

12. The piezoelectric printing device of claim 1, wherein the piezoelectric plate is poled along a direction that is perpendicular to the first surface of the piezoelectric plate.

13. The piezoelectric printing device of claim 1, the array including at least one pair of staggered rows of drop ejectors including a first staggered row and a second staggered row, wherein the nozzles of the first staggered row are proximate to the nozzles of the second staggered row, and wherein the pressure chambers of the first staggered row and the pressure chambers of the second staggered row extend in opposite directions from the respective nozzles.

14. The piezoelectric printing device of claim 13, wherein the signal input pads of the first staggered row of drop ejectors and the signal input pads of the second staggered row of drop ejectors are disposed between the nozzles of the first staggered row of drop ejectors and the nozzles of the second staggered row of drop ejectors; and wherein the common ground bus is disposed between the signal input pads of the first staggered row of drop ejectors and the signal input pads of the second staggered row of drop ejectors.

15. The piezoelectric printing device of claim 1, wherein T is less than 0.5 W.

16. The piezoelectric printing device of claim 1, wherein a distance between a signal line and an adjacent ground trace is greater than 0.1 W.

17. The piezoelectric printing device of claim 1, wherein a width of a signal line is greater than 0.1 W.

18. The piezoelectric printing device of claim 1, wherein a distance between a signal line and an adjacent ground trace is greater than 0.5T and less than 2T.

19. The piezoelectric printing device of claim 1, wherein a width of a signal line is greater than 0.2T.

20. The piezoelectric printing device of claim 1, wherein each signal line is disposed over a corresponding pressure chamber and extends in a direction perpendicular to the row direction.

21. The piezoelectric printing device of claim 20, wherein each signal line is disposed over a center of the corresponding pressure chamber.

22. The piezoelectric printing device of claim 1, wherein the ground traces are disposed midway between corresponding pressure chambers and extend in a direction perpendicular to the row direction.

23. The piezoelectric printing device of claim 1, wherein the ground traces have a width that is greater than a width of the side walls of the pressure chambers.

24. The piezoelectric printing device of claim 1, further comprising an intermediate insulating layer disposed between the inner first surface of the piezoelectric plate and the first side of the substrate.

25. The piezoelectric printing device of claim 24, wherein the intermediate insulating layer is disposed between the electrode layer and the bonding layer.

* * * * *